US005638802A

United States Patent [19]

Maki et al.

[11] Patent Number: 5,638,802

[45] Date of Patent: Jun. 17, 1997

[54] FUEL METERING CONTROL SYSTEM FOR INTERNAL COMBUSTION ENGINE

[75] Inventors: Hidetaka Maki; Shusuke Akazaki; Yusuke Hasegawa, all of Wako, Japan

[73] Assignee: Honda Giken Kogyo Kabushiki Kaisha, Tokyo, Japan

[21] Appl. No.: 602,114

[22] Filed: Feb. 23, 1996

[30] Foreign Application Priority Data

Feb. 25, 1995 [JP] Japan ..... 7-061662

[51] Int. Cl.[6] ..... F02D 41/14; G06G 7/70

[52] U.S. Cl. ..... 123/675; 364/431.052

[58] Field of Search ..... 123/674, 675, 123/679, 681, 682, 694; 60/276, 285; 364/431.05, 431.07, 431.12

[56] References Cited

U.S. PATENT DOCUMENTS

| | | | |
|---|---|---|---|
| 4,829,440 | 5/1989 | Abe | 123/674 |
| 4,854,287 | 8/1989 | Tomisawa | 123/675 |
| 4,913,122 | 4/1990 | Uchida et al. | 123/674 |
| 4,977,881 | 12/1990 | Abe et al. | 123/674 |
| 5,003,955 | 4/1991 | Haraguchi et al. | 123/675 |
| 5,024,199 | 6/1991 | Abe | 123/674 |
| 5,255,512 | 10/1993 | Hamburg et al. | 123/674 |
| 5,297,046 | 3/1994 | Nakaniwa | 123/674 |
| 5,341,641 | 8/1994 | Nakajima et al. | 123/674 |
| 5,427,082 | 6/1995 | Thomas et al. | 123/675 |

FOREIGN PATENT DOCUMENTS

| | | |
|---|---|---|
| 2-275043 | 11/1990 | Japan . |
| 4-209940 | 7/1992 | Japan . |

OTHER PUBLICATIONS

"Digital Adaptive Control" *Computrol*, No. 27, Jul. 10, 1989, pp. 28–41.

"Automotive Control Handbook", Ohm, Ltd., Japan, pp. 701–707, Oct. 1983.

"A Survey of Model Reference Adaptive Techniques—Theory and Applications", Landau, *Automatica*, vol. 10, Jan. 1974, pp. 353–379.

"Unification of Discrete Time Explicit Model Reference Adaptive Control Designs", Landau et al, *Automatica*, vol. 17, No. 4, Jan. 1981, pp. 593–611.

"Combining Model Reference Adaptive Controllers and Stochastic Self-tuning Regulators", Landau, *Automatica*, vol. 18, No. 1, Jan. 1982, pp. 77–84.

*Primary Examiner*—Willis R. Wolfe

*Attorney, Agent, or Firm*—Nikaido Marmelstein Murray & Oram LLP

[57] ABSTRACT

A system for controlling fuel metering for a multi-cylinder internal combustion engine, having a feedback loop which has an adaptive controller and an adaptation mechanism coupled to the adaptive controller for estimating controller parameters $\hat{\theta}$. The adaptive controller calculates a feedback correction coefficient using internal variables that include at least said controller parameters $\hat{\theta}$, to correct a basic quantity of fuel injection obtained by retrieving mapped data by engine speed and engine load, to bring a detected air/fuel ratio to a desired air/fuel ratio. In the system, the internal variables of the adaptive controller are set to predetermined values, when the supply of fuel is resumed after termination of the fuel cutoff, and the adaptive controller calculates the feedback correction coefficient based on the internal variables set to the predetermined value.

104 Claims, 6 Drawing Sheets

FUEL METERING CONTROL SYSTEM FOR INTERNAL COMBUSTION ENGINE

BACKGROUND OF THE INVENTION

1. Field of the Invention

This invention relates to a fuel metering control system for an internal combustion engine.

2. Description of the Related Art

The PID control law is ordinarily used for fuel metering control for internal combustion engines. The control error between the desired value and the controlled variable (plant output) is multiplied by a P term (proportional term), an I term (integral term) and a D term (differential or derivative term) to obtain the feedback correction coefficient (feedback gain). In addition, it has recently been proposed to obtain the feedback correction coefficient by use of modern control theory or the like, as taught by Japanese Laid-Open Patent Application Hei 4(1992)-209,940.

When conducting feedback control using a controller such as the adaptive controller, during a fuel cutoff, the exhaust air/fuel ratio should substantially be zero, since the supply of fuel is shut off and no combustion occurs. As the limit of the measurable range of the air/fuel sensor in the lean direction is approximately 30: 1, however, this state is beyond the limit, and it is impossible in practice to accurately detect the air/fuel ratio under such a no fuel supply state.

Accordingly, it is not possible to continue the adaptive control with properly calculated controller internal variables during the fuel cutoff, since the controller internal variables must be determined in response to the detected air/fuel ratio. Therefore, it is difficult to start the adaptive controller to properly operate immediately after resumption of the fuel supply following the termination of the fuel cutoff. This degrades the convergence rate or speed of control and hence control performance.

SUMMARY OF THE INVENTION

An object of the invention is therefore to provide a fuel metering control system for an internal combustion engine which can start the adaptive controller to properly operate immediately after the supply of fuel is resumed after the termination of the fuel cutoff, so as to improve the control convergence rate or speed, thereby enhancing the control performance.

A second object of the invention is therefore to provide a fuel metering control system for an internal combustion engine which can calculate a feedback correction coefficient such that the adaptive controller is started to properly operate immediately after the supply of fuel is resumed after the termination of the fuel cutoff, so as to improve the control convergence rate or speed, thereby enhancing the control performance.

This invention achieves the object by providing a system for controlling fuel metering for a multi-cylinder internal combustion engine, comprising an air/fuel ratio sensor located in an exhaust system of the engine for detecting an air/fuel ratio in exhaust gas of the engine, engine operating condition detecting means for detecting engine operating conditions including at least engine speed and engine load, basic fuel injection quantity determining means coupled to said engine operating condition detecting means, for determining a basic quantity of fuel injection for a cylinder of the engine based on at least the detected engine operating conditions, a feedback loop means coupled to said fuel injection quantity determining means, and having an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value, fuel cutoff determining means for determining fuel cutoff based on the detected engine operating conditions, output fuel injection quantity determining means for determining an output quantity of fuel injection, said output fuel injection quantity determining means correcting the basic quantity of fuel injection using said feedback correction coefficient when engine operation is discriminated to be in a feedback control region, said output fuel injection quantity determining means determining the output quantity of fuel injection to be zero to cut a supply of fuel into the engine off when said fuel cutoff determining means determines that the fuel is cut off, and fuel injection means coupled to said output fuel injection quantity determining means, for injecting fuel into the cylinder of the engine based on the output quantity of fuel injection. In the system, said feedback loop means sets at least one of the internal variables of the adaptive controller to a predetermined value when the supply of fuel is resumed after termination of the fuel cutoff, and causes the adaptive controller to calculate the feedback correction coefficient based on the internal variables set to the predetermined value.

BRIEF EXPLANATION OF THE DRAWINGS

These and other objects and advantages of the invention will be more apparent from the following description and drawings, which show the invention by way of example only, and in which.

DETAILED DESCRIPTION OF THE PREFERRED EMBODIMENTS

Embodiments of the invention, given by way of example only, will now be explained with reference to the drawings.

Figure 1:
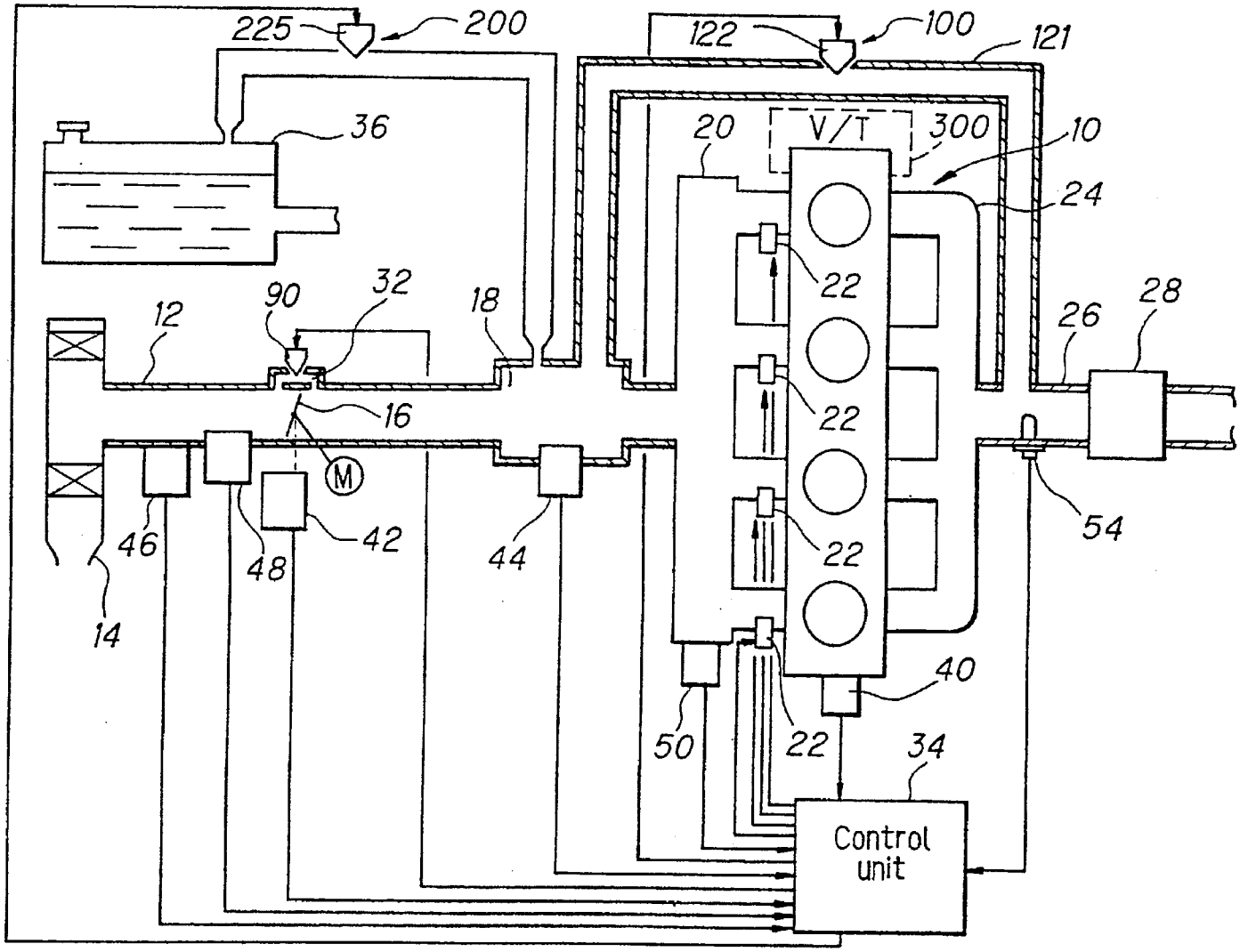
FIG. 1 is an overall schematic view showing a fuel metering control system for an internal combustion engine according to the present invention.

FIG. 1 is an overview of a fuel metering control system for an internal combustion engine according to the invention.

Reference numeral 10 in this figure designates an overhead cam (OHC) in-line four-cylinder (multi-cylinder) internal combustion engine. Air drawn into an air intake pipe 12 through an air cleaner 14 mounted on a far end thereof is supplied to each of the first to fourth cylinders through a surge tank 18, an intake manifold 20 and two intake valves (not shown), while the flow thereof is adjusted by a throttle valve 16. A fuel injector (fuel injection means) 22 is installed in the vicinity of the intake valves of each cylinder for injecting fuel into the cylinder. The injected fuel mixes with the intake air to form an air-fuel mixture that is ignited in the associated cylinder by a spark plug (not shown) in the firing order of #1, #3, #4 and #2 cylinder. The resulting combustion of the air-fuel mixture drives a piston (not shown) down.

The exhaust gas produced by the combustion is discharged through two exhaust valves (not shown) into an exhaust manifold 24, from where it passes through an exhaust pipe 26 to a catalytic converter (three-way catalyst) 28 where noxious components are removed therefrom before it is discharged to the exterior. Not mechanically linked with the accelerator pedal (not shown), the throttle valve 16 is controlled to a desired degree of opening by a stepping motor M. In addition, the throttle valve 16 is bypassed by a bypass 32 provided at the air intake pipe 12 in the vicinity thereof.

The engine 10 is equipped with an exhaust gas recirculation (EGR) mechanism 100 which recirculates a part of the exhaust gas to the intake side via a recirculation pipe 121, and a canister purge mechanism 200 connected between the air intake system and a fuel tank 36.

The engine 10 is also equipped with a variable valve timing mechanism 300 (denoted as V/T in FIG. 1). As taught by Japanese Laid-open Patent Application No. Hei 2(1990) -275,043, for example, the variable valve timing mechanism 300 switches the opening/closing timing of the intake and/or exhaust valves between two types of timing characteristics: a characteristic for low engine speed designated LoV/T, and a characteristic for high engine speed designated HiV/T in response to engine speed Ne and manifold pressure Pb. Since this is a well-known mechanism, however, it will not be described further here. (Among the different ways of switching between valve timing characteristics is included that of deactivating one of the two intake valves.)

The engine 10 of FIG. 1 is provided in its ignition distributor (not shown) with a crank angle sensor 40 for detecting the piston crank angle and is further provided with a throttle position sensor 42 for detecting the degree of opening of the throttle valve 16, and a manifold absolute pressure sensor 44 for detecting the pressure Pb of the intake manifold downstream of the throttle valve 16 in terms of absolute value. An atmospheric pressure sensor 46 for detecting atmospheric pressure Pa is provided at an appropriate portion of the engine 10, an intake air temperature sensor 48 for detecting the temperature of the intake air is provided upstream of the throttle valve 16, and a coolant temperature sensor 50 for detecting the temperature of the engine coolant is also provided at an appropriate portion of the engine. The engine 10 is further provided with a valve timing (V/T) sensor 52 (not shown in FIG. 1) which detects the valve timing characteristic selected by the variable valve timing mechanism 300 based on oil pressure.

Further, an air/fuel sensor 54 constituted as an oxygen detector or oxygen sensor is provided in the exhaust pipe 26 at, or downstream of, a confluence point in the exhaust system, between the exhaust manifold 24 and the catalytic converter 28, where it detects the oxygen concentration in the exhaust gas at the confluence point and produces a corresponding signal (explained later). The outputs of the sensors are sent to the control unit 34.

Figure 2:
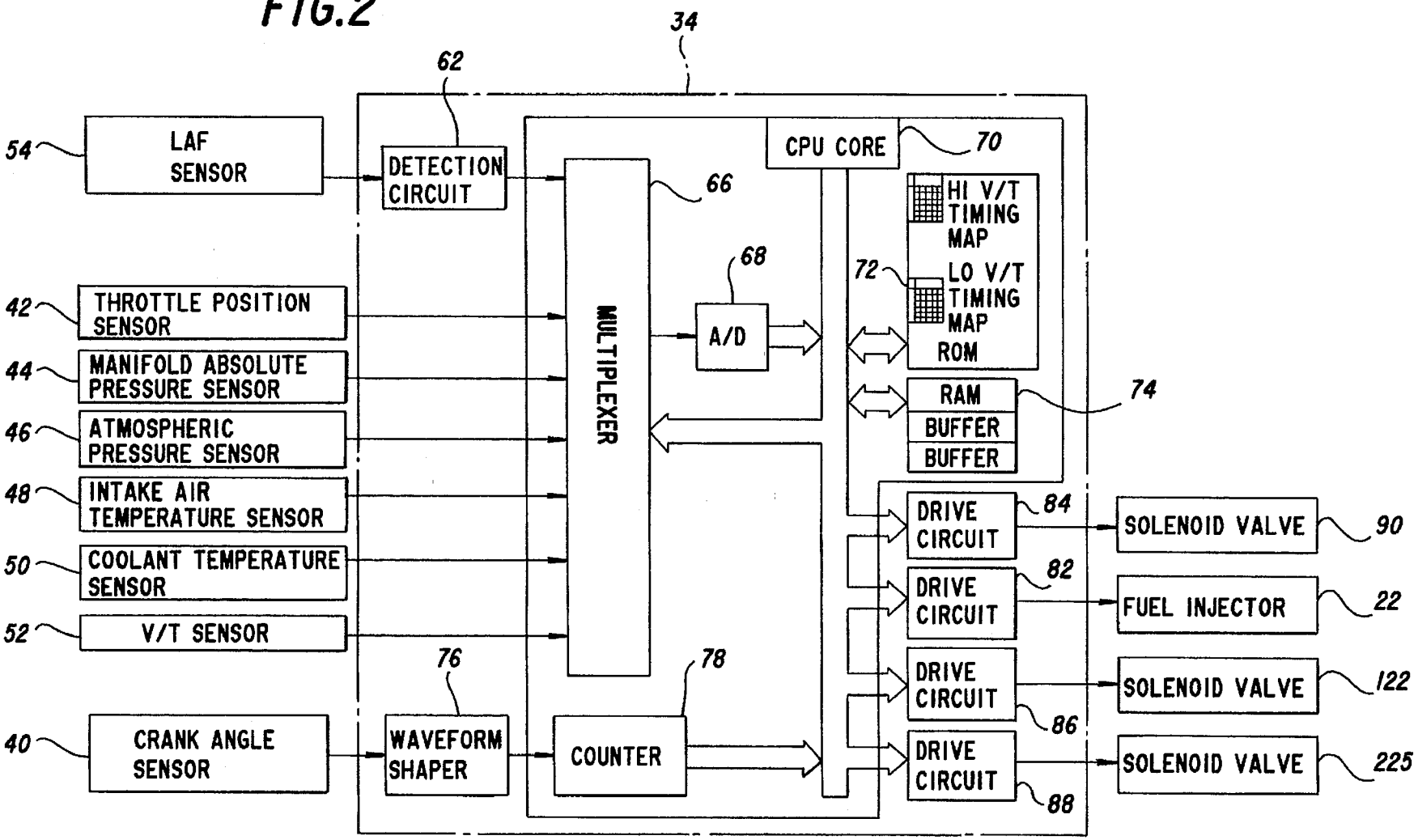
FIG. 2 is a block diagram showing the details of a control unit illustrated in FIG. 1.

Details of the control unit 34 are shown in the block diagram of FIG. 2. The output of the air/fuel ratio sensor 54 is received by a detection circuit 62, where it is subjected to appropriate linearization processing for producing an output in voltage characterized in that it varies linearly with the oxygen concentration of the exhaust gas over a broad range extending from the lean side to the rich side. (The air/fuel ratio sensor is denoted as "LAF sensor" in the figure and will be so referred to in the remainder of this specification.)

The limit of the measurable range of the LAF sensor 54 in the lean direction is approximately 30:1 in terms of the air/fuel ratio. Therefore, even when the air/fuel ratio should be substantially zero due to the fuel cutoff and some similar conditions, the LAF sensor output remains within this limit.

The output of the detection circuit 62 is forwarded through a multiplexer 66 and an A/D converter 68 to a CPU (central processing unit). The CPU has a CPU core 70, a ROM (read-only memory) 72 and a RAM (random access memory) 74, and the output of the detection circuit 62 is A/D-converted once every prescribed crank angle (e.g., 15 degrees) and stored in buffers of the RAM 74. Similarly, the analog outputs of the throttle position sensor 42, etc., are input to the CPU through the multiplexer 66 and the A/D converter 68 and stored in the RAM 74.

The output of the crank angle sensor 40 is shaped by a waveform shaper 76 and has its output value counted by a counter 78. The result of the count is input to the CPU. In accordance with commands stored in the ROM 72, the CPU core 70 computes a manipulated variable in the manner described later and drives the fuel injectors 22 of the respective cylinders via a drive circuit 82. Operating via drive circuits 84, 86 and 88, the CPU core 70 also drives a solenoid valve (EACV) 90 (for opening and closing the bypass 32 to regulate the amount of secondary air), a solenoid valve 122 for controlling the aforesaid exhaust gas recirculation and a solenoid valve 225 for controlling the aforesaid canister purge.

Figure 3:
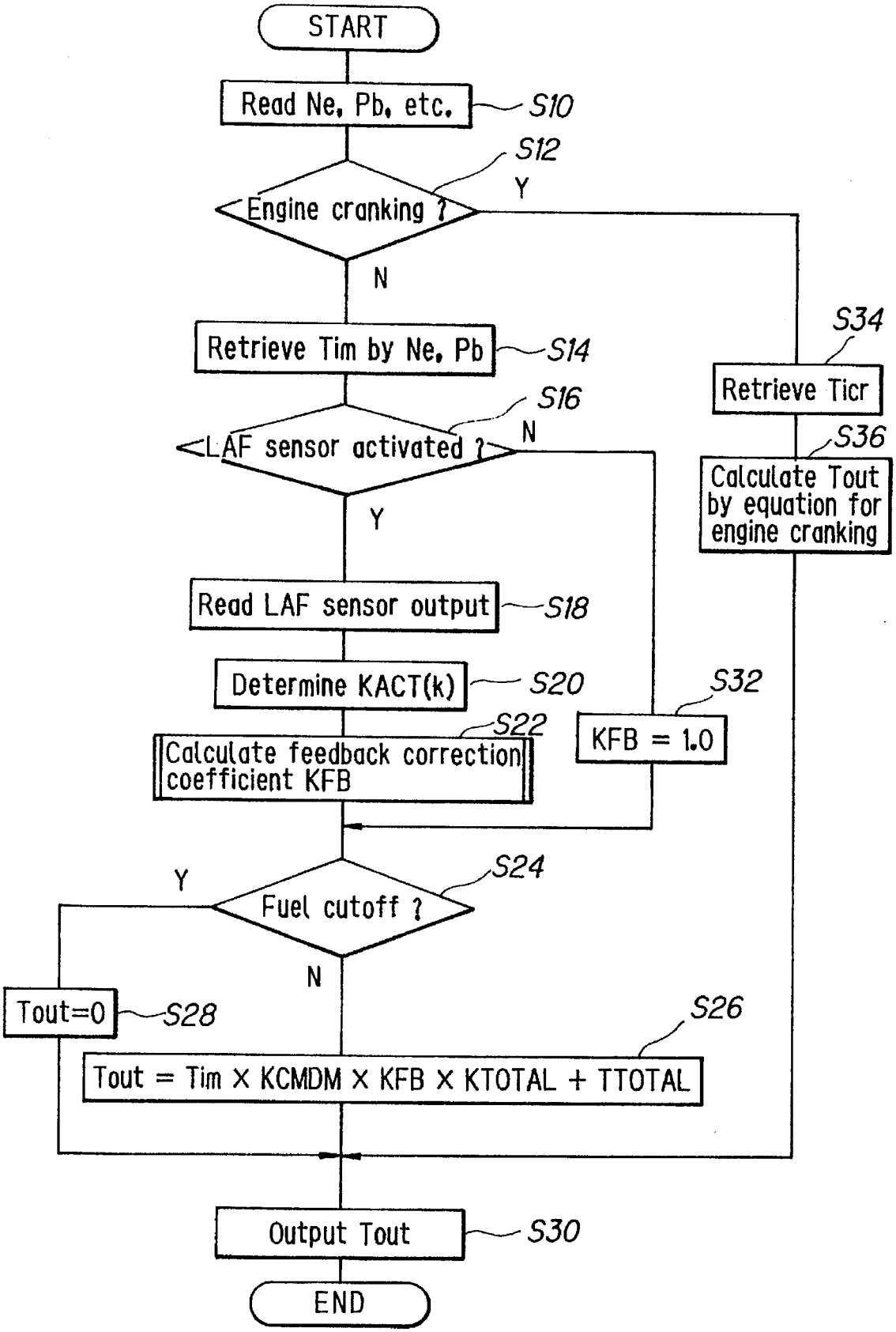
FIG. 3 is a flowchart showing the operation of the system according to the invention.

FIG. 3 is a flowchart showing the operation of the system. The program is activated at a predetermined crank angular position such as every TDC (Top Dead Center) of the engine.

Figure 4:
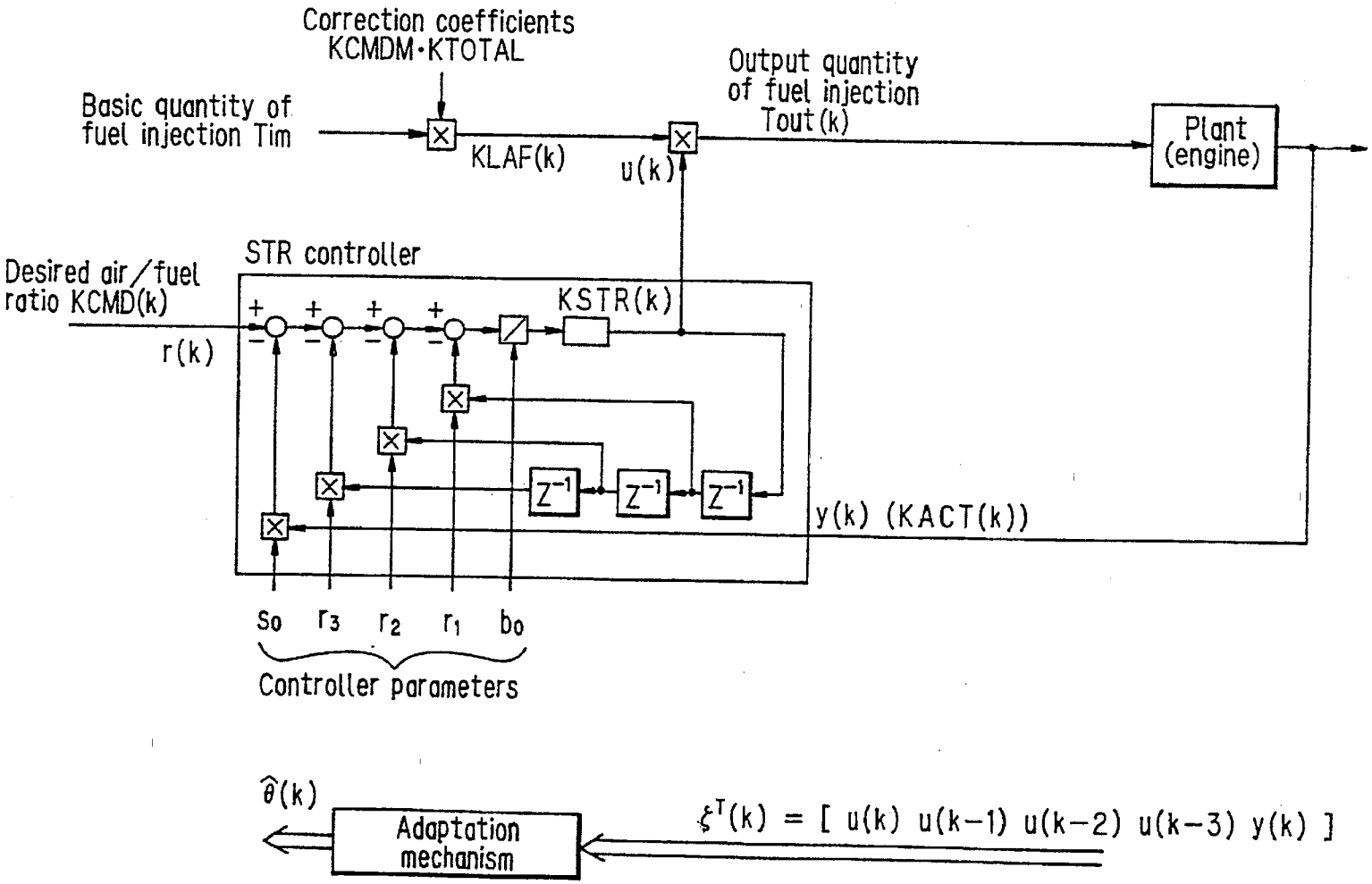
FIG. 4 is a block diagram showing the configuration of the system.

In the system, as disclosed in the FIG. 4 block diagram, there is provided a feedback loop (means) having a controller means for calculating a feedback correction coefficient (shown as "KSTR(k)" in the figure) using a control law expressed in recursion formula, more particularly an adaptive controller of a type of STR (self-tuning regulator, shown as "STR controller" in the figure) to determine the manipulated variable in terms of the amount of fuel supply (shown as "Basic quantity of fuel injection Tim" in the figure), such that the detected exhaust air/fuel ratio (shown as "KACT(k)" in the figure) is brought to a desired air/fuel ratio (shown as "KCMD(k)" in the figure). Here, k is a sample number in the discrete time system.

It should be noted that the detected air/fuel ratio and the desired air/fuel ratio are expressed as, in fact, the equivalence ratio, i.e., as Mst/M= 1 /lambda (Mst: stoichiometric air/fuel ratio; M: A/F (A: air mass flow rate; F: fuel mass flow rate; lambda: excess air factor), so as to facilitate the calculation.

In FIG. 3, the program starts at S10 in which the detected engine speed Ne, the manifold pressure Pb, etc., are read and the program proceeds to S12 in which it is checked whether or not the engine is cranking, and if it is not, to S14 in which the basic quantity of fuel injection Tim is calculated by retrieval from mapped data using the detected engine speed Ne and manifold pressure Pb as address data. Next, the program proceeds to S16 in which it is checked whether activation of the LAF sensor 54 is completed. This is done by comparing the difference between the output voltage and the center voltage of the LAF sensor 54 with a prescribed value (0.4 V, for example) and determining that the activation has been completed when the difference is smaller than the prescribed value.

When S16 finds that the activation has been completed, the program goes to S18 in which the output of the LAF sensor is read, and to S20 in which the air/fuel ratio KACT(k) is determined or detected. The program then goes to S22 in which a feedback correction coefficient KFB is calculated.

Figure 5:
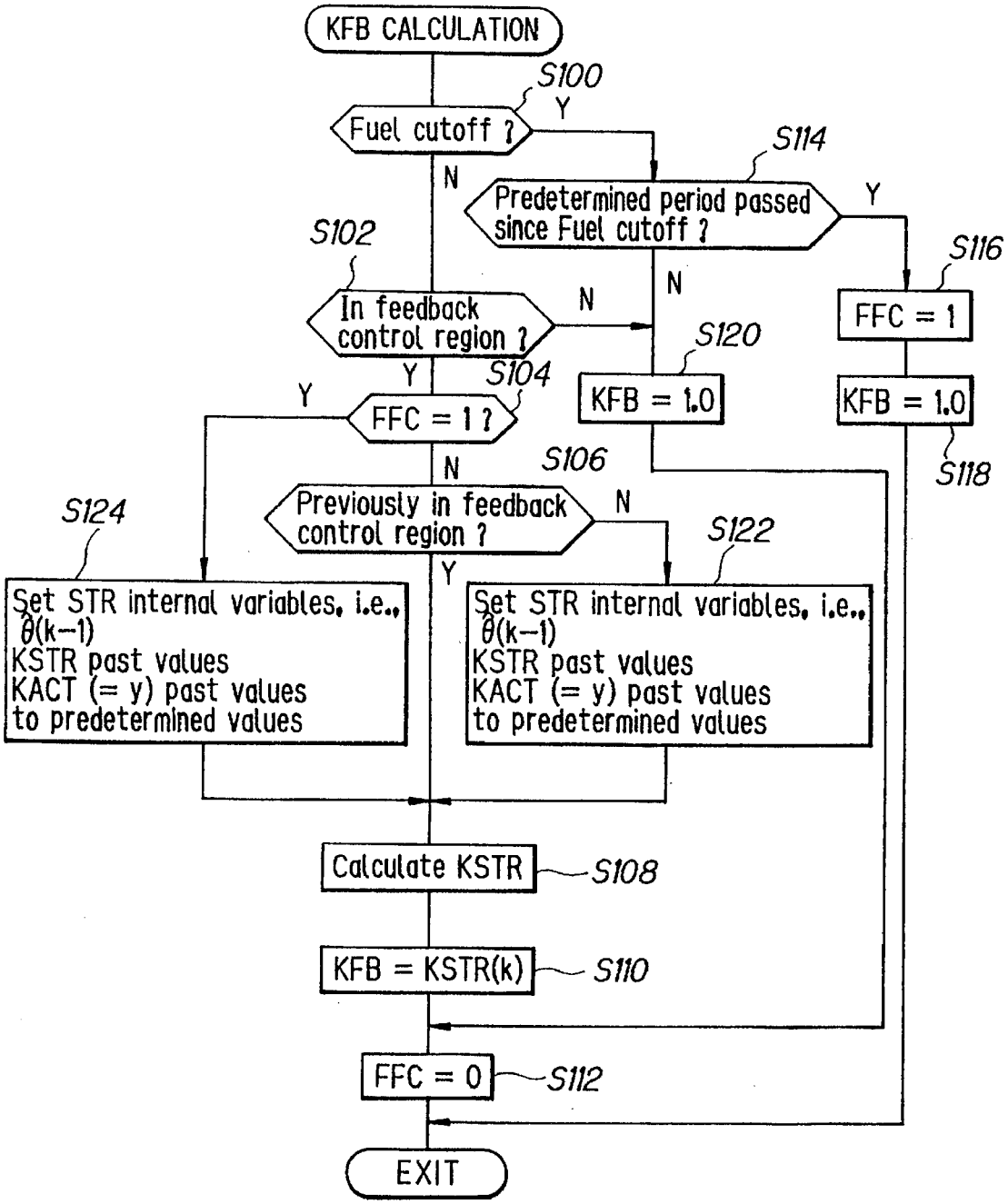
FIG. 5 is a subroutine flowchart of FIG. 3 showing the calculation of a feedback correction coefficient KFB referred to in FIG. 3.

FIG. 5 is a flowchart showing the calculation of the feedback correction coefficient KFB.

The program starts at S100 in which it is checked whether the supply of fuel is cut off. Fuel cutoff is implemented under a specific engine operating condition, such as when the throttle is fully closed and the engine speed is higher than a prescribed value, at which time the supply of fuel is stopped and fuel injection is controlled in an open-loop manner.

If the result of S100 is negative, the program proceeds to S102 in which it is checked whether the engine operation is in a feedback control region. This is conducted using a separate subroutine not shown in the drawing. Fuel metering is controlled in an open-loop fashion, for example, such as during full-load enrichment or high engine speed, or when the engine operating condition has changed suddenly owing to the operation of the exhaust gas recirculation mechanism.

When the result in S102 is YES, the program proceeds to S104 in which it is checked whether the bit of a flag FFC (explained later) is ON (=1) and if the result is NO, the program proceeds to S106 in which it is checked whether the engine operating condition at the preceding (control) cycle, i.e., at the time that the FIG. 3 flow-chart was activated in the preceding (control) cycle, was in the feedback control region. When the result at S106 is affirmative, the program proceeds to S108 in which the feedback correction coefficient is calculated using the adaptive control law. The feedback correction coefficient will hereinafter be referred to as the "adaptive correction coefficient KSTR".

Explaining this, the system illustrated in FIG. 4 is based on adaptive control technology proposed in an earlier application by the assignee. It comprises an adaptive controller constituted as an STR (self-tuning regulator) controller (controller means) and an adaptation mechanism (adaptation mechanism means) (system parameter estimator) for estimating/identifying the controller parameters (system parameters) $\hat{\theta}$. The desired value and the controlled variable (plant output) of the fuel metering feedback control system are input to the STR controller, which receives the coefficient vector (i.e., the controller parameters expressed in a vector) $\hat{\theta}$ estimated/identified by the adaptation mechanism, and generates an output.

One identification or adaptation law (algorithm) available for adaptive control is that proposed by I. D. Landau et al. In the adaptation law proposed by I. D. Landau et al., the stability of the adaptation law expressed in a recursion formula is ensured at least using Lyapunov's theory or Popov's hyperstability theory. This method is described in, for example, *Computrol* (Corona Publishing Co., Ltd.) No. 27, pp. 28–41; *Automatic Control Handbook* (Ohm Publishing Co., Ltd.) pp. 703–707; "A Survey of Model Reference Adaptive Techniques—Theory and Applications" by I. D. Landau in *Automatica*, Vol. 10, pp. 353–379, 1974; "Unification of Discrete Time Explicit Model Reference Adaptive Control Designs" by I. D. Landau et al. in *Automatica*, Vol. 17, No. 4, pp. 593–611, 1981; and "Combining Model Reference Adaptive Controllers and Stochastic Self-tuning Regulators" by I. D. Landau in *Automatica*, Vol. 18, No. 1, pp. 77–84, 1982.

The adaptation or identification algorithm of I. D. Landau et al. is used in the assignee's earlier proposed adaptive control technology. In this adaptation or identification algorithm, when the polynomials of the denominator and numerator of the transfer function $B(Z^{-1})/A(Z^{-1})$ of the discrete controlled system are defined in the manner of Eq. 1 and Eq. 2 shown below, then the controller parameters or system (adaptive) parameters $\hat{\theta}$ (k) are made up of parameters as shown in Eq. 3 and are expressed as a vector (transpose vector). And the input zeta (k), which is input to the adaptation mechanism becomes that shown by Eq. 4. Here, there is taken as an example a plant in which m=1, n=1 and d=3, namely, the plant model is given in the form of a linear system with three control cycles of dead time.

$$A(z^{-1}) = 1 + a_1 z^{-1} + \ldots + a_n z^{-n} \quad \text{Eq. 1}$$

$$B(z^{-1}) = b_0 + b_1 z^{-1} + \ldots + a_m z^{-m} \quad \text{Eq. 2}$$

$$\begin{aligned}\hat{\theta}^T(k) &= [\hat{b}_0(k), \hat{B}_R(z^{-1}, k), \hat{S}(z^{-1}, k)] \quad \text{Eq. 3}\\ &= [\hat{b}_0^{-1}(k), \hat{r}_1(k), \ldots, r_{m+d-1}(k), s_0(k), \ldots, s_{n-1}(k)]\\ &= [b_0(k), r_1(k), r_2(k), r_3(k), s_0(k)]\end{aligned}$$

$$\begin{aligned}\zeta^T(k) &= [u(k), \ldots, u(k-m-d+1), y(k), \ldots, y(k-n+1)] \quad \text{Eq. 4}\\ &= [u(k), u(k-1), u(k-2), u(k-3), y(k)]\end{aligned}$$

Here, the factors of the controller parameters $\hat{\theta}$, i.e., the scalar quantity $\hat{b}_0^{-1}$ (k) that determines the gain, the control factor $\hat{B}_R(Z^{-1}, k)$ that uses the manipulated variable and $\hat{S}(Z^{-1}, k)$ that uses the controlled variable, all shown in Eq. 3, are expressed respectively as Eq. 5 to Eq. 7.

$$b_0^{-1}(k) = 1/b_0 \quad \text{Eq. 5}$$

$$\begin{aligned}B_R(Z^{-1}, k) &= r_1 z^{-1} + r_2 z^{-2} + \ldots + r_{m+d-1} z^{-(m+d-1)} \quad \text{Eq. 6}\\ &= r_1 z^{-1} + r_2 z^{-2} + = r_3 z^{-3}\end{aligned}$$

$$\begin{aligned}S(Z^{-1}, k) &= s_0 + s_1 z^{-1} + \ldots + s_{n-1} z^{(n-1)} \quad \text{Eq. 7}\\ &= s_0\end{aligned}$$

As shown in Eq. 3, the adaptation mechanism estimates or identifies each coefficient of the scalar quantity and control factors, calculates the controller parameters (vector) $\hat{\theta}$, and supplies the controller parameters $\hat{\theta}$ to the STR controller. More specifically, the adaptation mechanism calculates the controller parameters $\hat{\theta}$ using the manipulated variable u(i) and the controlled variable y(j) of the plant (i,j include past values) such that the control error between the desired value and the controlled variable becomes zero.

More precisely, the controller parameters (vector) $\hat{\theta}$(k) are calculated by Eq. 8 below. In Eq. 8, Γ(k) is a gain matrix (the (m+n+d)th order square matrix) that determines the estimation/identification rate or speed of the controller parameters $\hat{\theta}$, and e*(k) is a signal indicating the generalized estimation/identification error, i.e., an estimation error signal of the controller parameters. They are represented by recursion formulas such as those of Eqs. 9 and 10.

$$\hat{\theta}(k) = \hat{\theta}(k-1) + \Gamma(k-1)\zeta(k-d)e^*(k) \quad \text{Eq. 8}$$

$$\Gamma(k) = \frac{1}{\lambda_1(k)}\left[\Gamma(k-1) - \frac{\lambda_2(k)\Gamma(k-1)\zeta(k-d)\zeta^T(k-d)\Gamma(k-1)}{\lambda_1(k) + \lambda_2(k)\zeta^T(k-d)\Gamma(k-1)\zeta(k-d)}\right] \quad \text{Eq. 9}$$

-continued $$e^*(k) = \frac{D(z^{-1})y(k) - \hat{\theta}^T(k-1)\zeta(k-d)}{1 + \zeta^T(k-d)\Gamma(k-1)\zeta(k-d)} \quad \text{Eq. 10}$$

Various specific algorithms are given depending on the selection of lambda 1(k) and lambda 2(k) in Eq. 9. lambda 1(k)=1 , lambda 2(k)=lambda (0<lambda<2) gives the gradually-decreasing gain algorithm (least-squares method when lambda=1); and lambda 1(k)=lambda 1(0<lambda 1<), lambda 2(k)=lambda 2 (0<lambda 2<lambda) gives the variable-gain algorithm (weighted least-squares method when lambda 2=1). Further, defining lambda 1(k)/lambda 2(k)=σ and representing lambda 3(k) as in Eq. 11, the constant-trace algorithm is obtained by defining lambda lambda 1(k)=lambda 3(k). Moreover, lambda 1 (k)=1, lambda 2(k)=0 gives the constant-gain algorithm. As is clear from Eq. 9, in this case Γ(k)=Γ(k−1), resulting in the constant value Γ(k)=Γ. Any of the algorithms are suitable for the time-varying plant such as the fuel metering control system according to the invention.

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)} \quad \text{Eq. 11}$$

In the diagram of FIG. 4, the STR controller (adaptive controller) and the adaptation mechanism (system parameter estimator) are placed outside the system for calculating the quantity of fuel injection (fuel injection quantity determining means) and operate to calculate the feedback correction coefficient KSTR(k) so as to adaptively bring the detected value KACT(k) to the desired value KCMD(k−d') (where, as mentioned earlier, d' is the dead time before KCMD is reflected in KACT). In other words, the STR controller receives the coefficient vector $\hat{\theta}(k)$ adaptively estimated/identified by the adaptive mechanism and forms a feedback compensator (feedback control loop) so as to bring it to the desired value KCMD(k−d'). The basic quantity of fuel injection Tim is multiplied by the calculated feedback correction coefficient KSTR(k), and the corrected quantity of fuel injection is supplied to the controlled plant (internal combustion engine) as the output quantity of fuel injection Tout(k).

Thus, the feedback correction coefficient KSTR(k) and the detected air/fuel ratio KACT(k) are determined and input to the adaptation mechanism, which calculates/estimates the controller parameters (vector) $\hat{\theta}(k)$ that are in turn input to the STR controller. Based on these values, the STR controller uses the recursion formula to calculate the feedback correction coefficient KSTR(k) so as to bring the detected air/fuel ratio KACT(k) to the desired air/fuel ratio KCMD (k−d'). The feedback correction coefficient KSTR(k) is specifically calculated as shown by Eq. 12:

$$KSTR(k) = \frac{KCMD(k-d') - s_0 \times y(k) - r_1 \times KSTR(k-1) - r_2 \times KSTR(k-2) - r_3 \times KSTR(k-3)}{b_0} \quad \text{Eq. 12}$$

Returning to FIG. 5, the program proceeds to S110 in which the adaptive correction coefficient KSTR(k) is renamed as the feedback correction coefficient KFB.

On the other hand, when S100 finds that the supply of fuel is cut off, the program proceeds to S114 in which it is checked whether a predetermined period has expired since the fuel cutoff. As stated above, the calculation of the adaptive correction coefficient KSTR requires past values of the internal variables of the adaptive (STR) controller. Assuming that the dead time is 3 in Eq. 3, it requires the values for a period of 3 combustion cycles. Taking this as the number of TDCs in a four cylinder engine, this requires the past values up to 12 TDCs earlier. As a result, stable past values would not accordingly be available unless the fuel cutoff has been continued for a period corresponding to at least 12 TDCs. This judgment step is provided for discriminating this and in response to the result, the values of the internal variables will be determined, as will be explained later.

When the judgment in S114 is affirmative, the program proceeds to S116 in which the bit of the flag is turned ON (=1), to S118 in which the feedback correction coefficient KFB is set to 1.0, indicating the fuel metering should be controlled in the open-loop fashion. The program is then terminated. When the result in S114 is negative, on the other hand, the program proceeds to S120 in which the coefficient KFB is set to 1.0, and to S112 in which the bit of the flag is turned OFF (=0), since the predetermined period has not passed.

When S100 finds that the fuel cutoff is not in progress at the next program loop or thereafter, the program proceeds to S102 in which it is checked whether the engine operating condition is in the feedback control region. Since the fuel cutoff is terminated and the supply of fuel is resumed, the result of S102 is naturally affirmative so that the program goes to S104 in which it is checked whether the bit of the flag is ON (=1).

Assume that the fuel cut was once made, but now terminated before the predetermined period has passed and it is just after the fuel supply has been resumed. Therefore, the judgment in S104 will be negative so that the program proceeds to S106 in which it is checked whether the last control cycle (program loop) was in the feedback control region. The result in S106 is accordingly negative in this situation and the program proceeds to S122 in which the internal variables of the adaptive controller, i.e., the controller parameters $\hat{\theta}(k-1)$, the past values of the adaptive correction coefficient KSTR and the past values of the exhaust air/fuel ratio KACT (=y) are set to values as will be explained later. The same will also apply when the open-loop control was conducted in the previous control cycle due to a reason other than the fuel cutoff and has now returned to the feedback control.

This will now be explained.

The aforesaid adaptation mechanism receives zeta(k−d), i.e., a vector which is a set or group of the current and past values of the plant input u(k)(=KSTR(k)) and the plant output y(k)(=KACT(k)) and based on the cause-and-effect relationship of the plant input and output, calculates the controller parameters $\hat{\theta}(k)$. Here, u(k) is the correction coefficient used for correcting the quantity of fuel injection, as just mentioned.

Therefore, in case of initiating the adaptive control when the engine operating condition has just entered the feedback control region (adaptive control region), unless the past value of the internal variables of the adaptive controller such as zeta (k−d), $\hat{\theta}(k-1)$ and gain matrix Γ(k−1) are prepared properly, there is the possibility that an improper adaptive correction coefficient KSTR is calculated. If the control is conducted using an improperly calculated adaptive correction coefficient, the system may, at worst, oscillate.

In view of the above, the system is configured in such a manner that the controller parameters $\hat{\theta}(k)$ are initially set such that the adaptive correction coefficient KSTR becomes 1.0 or thereabout assuming that u(k−i)=1(i≧1), when the feedback control is started or resumed. And at the same time, the system is arranged in such a manner that zeta(k–d) is initially set as shown in Eq. 13.

Since the gain matrix Γ(k–1) is a value that determines the estimation/identification rate or speed of the controller parameters, the gain matrix is initially set to a predetermined matrix such as its initial value. The gain matrix may alternatively be set to a smaller value in the aforesaid predetermined period starting from the fuel cutoff. This is because the feedback system is liable to destabilize just after the fuel is cut off. Setting the gain matrix to be smaller than the other engine operating conditions can therefore enhance the control stability.

The internal variable setting in S122 is only made when the fuel cutoff has not been continued for the period long enough for generating stable past values or when returning from the open-loop control implemented by a reason other than the fuel cutoff. These do not happen so frequently and most of the cases will be dealt with by the processing in S124. In other words, most often the fuel cut off will be continued for a period longer than 12 TDCs so that the combustion remains absent all the while, and the past values are considered to be stable. It is configured in S124 that, for that reason, the internal variable zeta(k–d) is set in S124 as shown in Eq. 14. The gain matrix Γ(k–1) and the controller parameters θ(k–1) are set in the same manner as that in S122 to make the adaptive correction coefficient≈1.0.

$$\begin{aligned}\zeta^T(k-d) &= [u(k-d)\ u(k-d-1)\ u(k-d-2)\ u(k-d-3)\ y(k-d)] \\ &= [KSTR(k-d) \quad KSTR(k-d-1) \quad KSTR(k-d-2) \quad KSTR(k-d-3) \quad KACT(k-d)] \\ &= [\ 1 \quad 1 \quad 1 \quad 1 \quad KCMD(k-d')]\end{aligned} \qquad \text{Eq. 13}$$

More specifically, since the adaptive correction coefficient KSTR(k) is calculated as Eq. 12, the system is configured to determine the values at the previous control cycle (past values) $\hat{\theta}(k-1)$ and zeta (k–d) such that the adaptive correction coefficient KSTR becomes 1.0 or thereabout.

$$\begin{aligned}\zeta^T(k-d) &= [u(k-d)\ u(k-d-1)\ u(k-d-2)\ u(k-d-3)\ y(k-d)] \\ &= [KSTR(k-d) \quad KSTR(k-d-1) \quad KSTR(k-d-2) \quad KSTR(k-d-3) \quad KACT(k-d)] \\ &= [\ 1 \quad 1 \quad 1 \quad 1 \quad 0\ ]\end{aligned} \qquad \text{Eq. 14}$$

For example, assume that the desired air/fuel ratio KCMD (k–d')(expressed in the equivalence ratio) is 1.0, KSTR(k–1)=KSTR(k–2)=KSTR(k–3)=1.0, and the initial values of the factors of the controller parameters $\hat{\theta}(k)$ are:

$r_1=0.1$
$r_2=0.05$
$r_3=0.05$
$s_0=0.3$
$b_0=0.5$

If the detected air/fuel ratio KACT(k) (expressed in the equivalence ratio)=1.0, the adaptive correction coefficient KSTR is:

$$\begin{aligned}KSTR &= (1-0.1\times 1-0.05\times 1-0.05\times 1-0.3\times KACT(k))/0.5 \\ &= 1.0\end{aligned}$$

Thus, the adaptive correction coefficient KSTR is 1.0 or thereabout, if the detected air/fuel ratio KACT(k) is 1.0 or thereabout.

This equals intentionally generating a past situation in which the adaptive correction coefficient KSTR(k–i)(i≧1) was 1.0 or thereabout, in other words, the detected air/fuel ratio KACT(k–j)(j≧1) was brought to a past desired air/fuel ratio KCMD(k–d') corresponding thereto and the control was stable.

Since the adaptive correction coefficient KSTR is fixed at 1.0 in the open-loop control, the feedback control can therefore be started using the same value, enabling no control hunting to occur, no air/fuel ratio spike to occur and to improve the control stability.

Again returning to the explanation of the FIG. 5 flowchart, assume that the fuel cutoff has been continued for a time equal to or greater than the predetermined period and the fuel supply is now resumed after the termination of the fuel cutoff. Therefore, the judgment in S104 is affirmative so that the program proceeds to S124 in which the internal variables are set in a manner explained below.

More specifically, both the desired air/fuel ratio and the exhaust air/fuel ratio are set to zero, while the controller parameters $\hat{\theta}(k-1)$ are set such that the coefficient KSTR eventually becomes 1.0 or thereabout. The gain matrix Γ(k–1) is set to its initial value. Initial values of the factors of the controller parameters $\hat{\theta}$ may be varied in response to the desired air/fuel ratio.

With the arrangement, it becomes possible to initiate the feedback control with the adaptive correction coefficient KSTR starting from 1.0, when the engine operation has just returned from the fuel cutoff. Saying this in other words, it becomes possible to obtain the controller parameters that equal the parameters required by an actual engine at the time just after the fuel supply is resumed. This configuration can prevent the controlled variable from overshooting at the time of resumption of fuel supply.

Returning to the FIG. 3 flowchart, the program then proceeds to S24 in which it is again checked whether the fuel is cut off and if it is not, to S26 in which the basic quantity of fuel injection (the amount of fuel supply) Tim is multiplied by a desired air/fuel ratio correction coefficient KCMDM (a value determined by correcting the desired air/fuel ratio (expressed in equivalence ratio) KCMD by the charging efficiency of the intake air), the feedback correction coefficient KFB and a product of other correction coefficients KTOTAL and is then added by the sum of additive correction terms TTOTAL to determine the output quantity of fuel injection Tout. The program then proceeds to S30 in which the output quantity of fuel injection Tout is applied to the fuel injector 22 as the manipulated variable.

Here, KTOTAL is the product of various correction coefficients to be made through multiplication including correction based on the coolant temperature correction. TTOTAL indicates the total value of the various corrections for atmospheric pressure, etc., conducted by addition (but does not include the fuel injector dead time, etc., which is added separately at the time of outputting the output quantity of fuel injection Tout).

When the judgment in S24 is affirmative, since this means the fuel supply should be shut off, the program proceeds to S28 in which the output quantity of fuel injection is set to zero. And when the result in S16 is NO, since this means that the control should be conducted in open-loop fashion, the program goes to S32 in which the feedback correction coefficient KFB is set to 1.0. If S12 finds that the engine is cranking, the program goes to S34 in which the quantity of fuel injection at cranking Ticr is retrieved, and then to S36 in which Ticr is used to calculate the output quantity of fuel injection Tout based on an equation for engine cranking.

Configured in the foregoing manner, the embodiment sets both the desired air/fuel ratio and the exhaust air/fuel ratio to zero, while setting the controller parameters $\hat{\theta}(k-1)$ to values such that the coefficient KSTR eventually becomes 1.0 or thereabout. With the arrangement, it becomes possible to initiate the feedback control with the adaptive correction coefficient KSTR starting from 1.0 when the engine operation has just returned from the fuel cutoff condition, in other words, it becomes possible to obtain the controller parameters that equal the parameters required by an actual engine at the time Just after the fuel supply is resumed, preventing the controlled variable from overshooting at the time of resumption of fuel supply.

Moreover, the embodiment is configured such that the feedback control is initiated with the adaptive correction coefficient KSTR starting from 1.0 even when the engine operation has just returned from the open-loop control implemented by a reason other than the fuel cutoff, and it can prevent the control hunting or an air/fuel ratio spike from occurring.

By the feedback correction coefficient calculated based on the high control response adaptive controller, on the other hand, when the detected air/fuel ratio becomes stable, the control error between the desired air/fuel ratio and the detected exhaust air/fuel ratio can then be decreased to zero or converged at one time. In addition, since the basic quantity of fuel injection is multiplied by the feedback correction coefficient to determine the manipulated variable, the stability and convergence of the control can be balanced appropriately.

Figure 6:
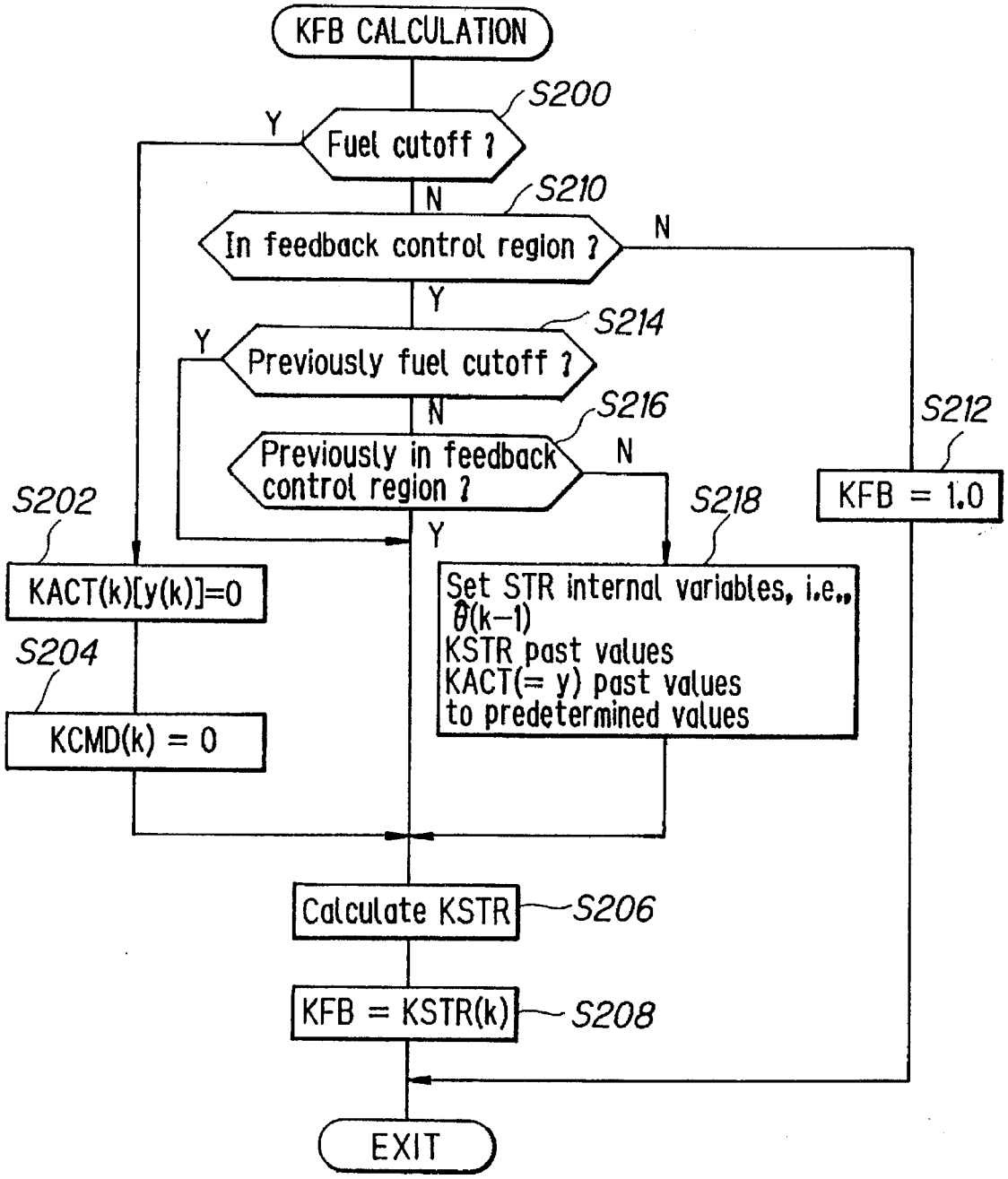
FIG. 6 is a view, similar to FIG. 5, but showing the calculation in a second embodiment of the invention.

FIG. 6 is a flowchart, similar to FIG. 5, but showing the calculation in a second embodiment of the invention.

Explaining the second embodiment while putting the emphasis on the difference from the first embodiment, in the second embodiment, the adaptive correction coefficient calculation is still done during the fuel cutoff.

Explaining the flowchart of FIG. 6, the program starts in S200 in which it is checked whether the supply of fuel is cut off and if affirmative, the program proceeds to S202 in which the detected or determined air/fuel ratio KACT(k)(=plant output y(k)) is set to zero, to S204 in which the desired air/fuel ratio KCMD(k) is also set to zero, to S206 in which the adaptive correction coefficient KSTR is calculated in the same manner as the first embodiment, and to S208 in which the adaptive correction coefficient KSTR(k) is renamed as the feedback correction coefficient KFB.

When the result in S200 is NO, the program proceeds to S210 in which it is checked whether it is in the feedback control region and if not, to S212 in which the feedback correction coefficient KFB is set to 1.0. If it is, on the other hand, the program proceeds to S216 via S214 in which it is checked whether the last control cycle (program loop) was in the feedback control region and if it was, to S206. If it was not, on the other hand, the program proceeds to S218 in which the controller internal variables are set to the values in the same manner as the first embodiment.

In the above, S214 is placed before S216 to check whether the supply of fuel was cut off in the last control cycle (program loop) and if the result is affirmative, the program is configured to skip S216. This is because the KSTR calculation is continued, during the fuel cutoff, in S202, S204, S206 even under such an open-loop control region, making the processing in S218 unnecessary.

It should be noted that, during the fuel cutoff and a predetermined period starting from the fuel cutoff, the gain matrix may be set to a smaller value than that in the other engine operating conditions.

The second embodiment thus differs from the first embodiment in that the calculation of the adaptive correction coefficient KSTR is continued even during the fuel cutoff. In addition, the second embodiment makes it unnecessary to reset the internal variables such as the controller parameters $\hat{\theta}$ each program loop. By setting both the detected and desired air/fuel ratios to zero during the fuel cutoff, the STR controller can continue to stably calculate the controller parameters $\hat{\theta}$ all the while. With the arrangement, it becomes possible to ensure the continuity of the control, enhancing convergence rate or speed and stability. In addition, since the controller parameters $\hat{\theta}$ are always calculated, this can cope with the fuel cutoff made for even a short period such as several TDCs, rendering the system advantageous.

Although the determination of the fuel cutoff is carried out from the engine operating condition, since the LAF sensor output is kept within the measurable limit in the lean direction during the fuel cutoff, it is alternatively possible to determine the fuel cutoff by comparing the LAF sensor output with a reference value indicating the limit in the lean direction.

Although only the correction coefficient obtained by the high response adaptive controller is used as the feedback correction coefficient in the first and second embodiments, it is alternatively possible to prepare another correction coefficient calculated by a low response controller such as a PID controller and to switch them in the feedback control region.

Although the air/fuel ratio is used as the desired value in the first and second embodiments, it is alternatively possible to use the quantity of fuel injection itself as the desired value.

Although the feedback correction coefficient is determined as a multiplication coefficient in the first and second embodiments, it can instead be determined as an additive value.

Although a throttle valve is operated by the stepper motor in the first and second embodiments, it can instead be mechanically linked with the accelerator pedal and be directly operated in response to the accelerator depression.

Furthermore, although the aforesaid embodiments are described with respect to examples using STR, MRACS (model reference adaptive control systems) can be used instead.

Although the invention has thus been shown and described with reference to specific embodiments, it should be noted that the invention is in no way limited to the details of the described arrangements but changes and modifications may be made without departing from the scope of the invention, which is defined by the appended claims.

What is claimed is:

1. A system for controlling fuel metering for a multi-cylinder internal combustion engine, comprising:

an air/fuel ratio sensor located in an exhaust system of the engine for detecting an air/fuel ratio in exhaust gas of the engine;

engine operating condition detecting means for detecting engine operating conditions including at least engine speed and engine load;

basic fuel injection quantity determining means coupled to said engine operating condition detecting means, for determining a basic quantity of fuel injection for a cylinder of the engine based on at least the detected engine operating conditions;

a feedback loop means coupled to said basic fuel injection quantity determining means, and having an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value;

fuel cutoff determining means for determining fuel cutoff based on the detected engine operating conditions;

output fuel injection quantity determining means for determining an output quantity of fuel injection, said output fuel injection quantity determining means correcting the basic quantity of fuel injection using said feedback correction coefficient when engine operation is discriminated to be in a feedback control region, said output fuel injection quantity determining means determining the output quantity of fuel injection to be zero to cut a supply of fuel into the engine off when said fuel cutoff determining means determines that the fuel is cut off; and fuel injection means coupled to said output fuel injection quantity determining means, for injecting fuel into the cylinder of the engine based on the output quantity of fuel injection;

wherein:

said feedback loop means set at least one of the internal variables of the adaptive controller to a predetermined value when the supply of fuel is resumed after termination of the fuel cutoff, and causes the adaptive controller to calculate the feedback correction coefficient based on the internal variables set to the predetermined value.

2. A system according to claim 1, wherein the one of the internal variables set to the predetermined value is an input, which is input to the adaptation mechanism.

3. A system according to claim 1, wherein the one of the internal variables includes its past value.

4. A system according to claim 1, wherein the feedback correction coefficient is multiplied by the basic quantity of fuel injection.

5. A system according to claim 1, wherein the internal variables are expressed in a recursion formula.

6. A system according to claim 1, wherein said feedback loop means sets at least one of the internal variables of the adaptive controller to a predetermined value for a predetermined period when the supply of fuel is resumed after termination of the fuel cutoff.

7. A system according to claim 6, wherein the gain matrix is set to a value smaller than that set after the predetermined period has passed.

8. A system according to claim 1, wherein the one of the internal variables set to the predetermined value is a gain matrix that determines an estimation speed of the controller parameters.

9. A system according to claim 8, wherein the gain matrix is set to its initial value.

10. A system according to claim 8, wherein the one of the internal variables set to the predetermined value is an input, which is input to the adaptation mechanism.

11. A system according to claim 1, wherein the one of the internal variables set to the predetermined value is the controller parameters.

12. A system according to claim 11, wherein the controller parameters are set such that the feedback correction coefficient is 1.0 or thereabout.

13. A system according to claim 11, wherein the one of the internal variables set to the predetermined value is an input, which is input to the adaptation mechanism.

14. A system according to claim 11, wherein the one of the internal variables set to the predetermined value is a gain matrix that determines an estimation speed of the controller parameters.

15. A system according to claim 14, wherein the gain matrix is set to its initial value.

16. A system according to claim 11, wherein said feedback loop means sets at least one of the internal variables of the adaptive controller to a predetermined value for a predetermined period when the supply of fuel is resumed after termination of the fuel cutoff.

17. A system according to claim 16, wherein the gain matrix is set to a value smaller than that set after the predetermined period has passed.

18. A system according to claim 1, wherein the one of the internal variables set to the predetermined value is the detected air/fuel ratio.

19. A system according to claim 18, wherein the one of the internal variables set to the predetermined value is an input, which is input to the adaptation mechanism.

20. A system according to claim 18, wherein the one of the internal variables set to the predetermined value is the controller parameters.

21. A system according to claim 20, wherein the controller parameters are set such that the feedback correction coefficient is 1.0 or thereabout.

22. A system according to claim 18, wherein the one of the internal variables set to the predetermined value is a gain matrix that determines an estimation speed of the controller parameters.

23. A system according to claim 22, wherein the gain matrix is set to its initial value.

24. A system according to claim 18, wherein said feedback loop means sets at least one of the internal variables of the adaptive controller to a predetermined value for a predetermined period when the supply of fuel is resumed after termination of the fuel cutoff.

25. A system according to claim 24, wherein the gain matrix is set to a value smaller than that set after the predetermined period has passed.

26. A system according to claim 1, wherein the one of the internal variables set to the predetermined value is the feedback correction coefficient.

27. A system according to claim 26, wherein the one of the internal variables set to the predetermined value is the detected air/fuel ratio.

28. A system according to claim 26, wherein the one of the internal variables set to the predetermined value is an input, which is input to the adaptation mechanism.

29. A system according to claim 26, wherein the one of the internal variables set to the predetermined value is the controller parameters.

30. A system according to claim 29, wherein the controller parameters are set such that the feedback correction coefficient is 1.0 or thereabout.

31. A system according to claim 26, wherein the one of the internal variables set to the predetermined value is a gain matrix that determines an estimation speed of the controller parameters.

32. A system according to claim 31, wherein the gain matrix is set to its initial value.

33. A system according to claim 26, wherein said feedback loop means sets at least one of the internal variables of the adaptive controller to a predetermined value for a predetermined period when the supply of fuel is resumed after termination of the fuel cutoff.

34. A system according to claim 33, wherein the gain matrix is set to a value smaller than that set after the predetermined period has passed.

35. A system according to claim 1, wherein said feedback loop means causes the adaptive controller to continue to calculate the feedback correction coefficient during the fuel cutoff.

36. A system according to claim 35, wherein the desired value is a desired air/fuel ratio and said feedback loop means holds the desired air/fuel ratio to 0 during the fuel cutoff.

37. A system according to claim 35, wherein the one of the internal variables set to the predetermined value is the feedback correction coefficient.

38. A system according to claim 35, wherein the one of the internal variables set to the predetermined value is the detected air/fuel ratio.

39. A system according to claim 35, wherein the one of the internal variables set to the predetermined value is an input, which is input to the adaptation mechanism.

40. A system according to claim 35, wherein said feedback loop means holds the detected air/fuel ratio to 0 during the fuel cutoff.

41. A system according to claim 40, wherein the desired value is a desired air/fuel ratio and said feedback loop means holds the desired air/fuel ratio to 0 during the fuel cutoff.

42. A system according to claim 35, wherein the one of the internal variables set to the predetermined value is the controller parameters.

43. A system according to claim 42, wherein the controller parameters are set such that the feedback correction coefficient is 1.0 or thereabout.

44. A system according to claim 35, wherein the one of the internal variables set to the predetermined value is a gain matrix that determines an estimation speed of the controller parameters.

45. A system according to claim 44, wherein the gain matrix is set to its initial value.

46. A system according to claim 35, wherein said feedback loop means sets at least one of the internal variables of the adaptive controller to a predetermined value for a predetermined period when the supply of fuel is resumed after termination of the fuel cutoff.

47. A system according to claim 46, wherein the gain matrix is set to a value smaller than that set after the predetermined period has passed.

48. A system according to claim 1, wherein said feedback loop means holds the feedback correction coefficient to a predetermined value during the fuel cutoff.

49. A system according to claim 48, wherein the predetermined value is 1.0.

50. A system according to claim 48, wherein the one of the internal variables set to the predetermined value is the feedback correction coefficient.

51. A system according to claim 48, wherein the one of the internal variables set to the predetermined value is the detected air/fuel ratio.

52. A system according to claim 48, wherein the one of the internal variables set to the predetermined value is an input, which is input to the adaptation mechanism.

53. A system according to claim 48, wherein the one of the internal variables set to the predetermined value is the controller parameters.

54. A system according to claim 53, wherein the controller parameters are set such that the feedback correction coefficient is 1.0 or thereabout.

55. A system according to claim 48, wherein the one of the internal variables set to the predetermined value is a gain matrix that determines an estimation speed of the controller parameters.

56. A system according to claim 55, wherein the gain matrix is set to its initial value.

57. A system according to claim 48, wherein said feedback loop means sets at least one of the internal variables of the adaptive controller to a predetermined value for a predetermined period when the supply of fuel is resumed after termination of the fuel cutoff.

58. A system according to claim 57, wherein the gain matrix is set to a value smaller than that set after the predetermined period has passed.

59. A computer program controlled system for controlling fuel metering for a multi-cylinder internal combustion engine, comprising:

an air/fuel ratio sensor located in an exhaust system of the engine for detecting an air/fuel ratio in exhaust gas of the engine;

engine operating condition detecting means for detecting engine operating conditions including at least engine speed and engine load;

basic fuel injection quantity determining means coupled to said engine operating condition detecting means, for determining a basic quantity of fuel injection for a cylinder of the engine based on at least the detected engine operating conditions;

a feedback loop means coupled to said basic fuel injection quantity determining means, and having an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value;

fuel cutoff determining means for determining fuel cutoff based on the detected engine operating conditions;

output fuel injection quantity determining means for determining an output quantity of fuel injection, said output fuel injection quantity determining means correcting the basic quantity of fuel injection using said feedback correction coefficient when engine operation is discriminated to be in a feedback control region, said output fuel injection quantity determining means determining the output quantity of fuel injection to be zero to cut a supply of fuel into the engine off when said fuel cutoff determining means determines that the fuel is cut off; and fuel injection means coupled to said output fuel injection quantity determining means, for injecting fuel into the cylinder of the engine based on the output quantity of fuel injection;

wherein:

said feedback loop means set at least one of the internal variables of the adaptive controller to a predetermined value when the supply of fuel is resumed after termination of the fuel cutoff, and causes the adaptive controller to calculate the feedback correction coefficient based on the internal variables set to the predetermined value.

60. A computer program controlled system according to claim 59, wherein said feedback loop means holds the feedback correction coefficient to a predetermined value during the fuel cutoff.

61. A computer program controlled system according to claim 59, wherein said feedback loop means causes the adaptive controller to continue to calculate the feedback correction coefficient during the fuel cutoff.

62. A computer program controlled system according to claim 59, wherein the one of the internal variables set to the predetermined value is the feedback correction coefficient.

63. A computer program controlled system according to claim 59, wherein the one of the internal variables set to the predetermined value is the detected air/fuel ratio.

64. A computer program controlled system according to claim 59, wherein the one of the internal variables set to the predetermined value is the controller parameters.

65. A computer program controlled system according to claim 59, wherein the one of the internal variables set to the predetermined value is a gain matrix that determines an estimation speed of the controller parameters.

66. A computer program controlled system according to claim 59, wherein the one of the internal variables set to the predetermined value is an input, which is input to the adaptation mechanism.

67. A computer program controlled system according to claim 59, wherein said feedback loop means sets at least one of the internal variables of the adaptive controller to a predetermined value for a predetermined period when the supply of fuel is resumed after termination of the fuel cutoff.

68. A computer program controlled system according to claim 59, wherein the one of the internal variables includes its past value.

69. A computer program controlled system according to claim 59, wherein the feedback correction coefficient is multiplied by the basic quantity of fuel injection.

70. A method for controlling fuel metering for a multi-cylinder internal combustion engine, comprising the steps of:

detecting an air/fuel ratio in exhaust gas of the engine;

detecting engine operating conditions including at least engine speed and engine load;

determining a basic quantity of fuel injection for a cylinder of the engine based on at least the detected engine operating conditions;

feedback controlling with an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value;

determining fuel cutoff based on the detected engine operating conditions;

determining an output quantity of fuel injection, while correcting the basic quantity of fuel injection using said feedback correction coefficient when engine operation is discriminated to be in a feedback control region, and determining the output quantity of fuel injection to be zero to cut a supply of fuel into the engine off when said fuel cutoff is determine; and injecting fuel into the cylinder of the engine based on the output quantity of fuel injection;

wherein:

setting at least one of the internal variables of the adaptive controller to a predetermined value when the supply of fuel is resumed after termination of the fuel cutoff, and causing the adaptive controller to calculate the feedback correction coefficient based on the internal variables set to the predetermined value.

71. A method according to claim 70, wherein the feedback correction coefficient is held to a predetermined value during the fuel cutoff.

72. A method according to claim 70, wherein the adaptive controller is caused to continue to calculate the feedback correction coefficient during the fuel cutoff.

73. A method according to claim 70, wherein the one of the internal variables set to the predetermined value is the feedback correction coefficient.

74. A method according to claim 70, wherein the one of the internal variables set to the predetermined value is the detected air/fuel ratio.

75. A method according to claim 70, wherein the one of the internal variables set to the predetermined value is the controller parameters.

76. A method according to claim 70, wherein the one of the internal variables set to the predetermined value is a gain matrix that determines an estimation speed of the controller parameters.

77. A method according to claim 70, wherein the one of the internal variables set to the predetermined value is an input, which is input to the adaptation mechanism.

78. A method according to claim 70 wherein, at least one of the internal variables of the adaptive controller is set to a predetermined value for a predetermined period when the supply of fuel is resumed after termination of the fuel cutoff.

79. A method according to claim 70, wherein the one of the internal variables includes its past value.

80. A method according to claim 70, wherein the feedback correction coefficient is multiplied by the basic quantity of fuel injection.

81. A method according to claim 70, wherein the internal variables are expressed in a recursion formula.

82. A computer program for controlling fuel metering for a multi-cylinder internal combustion engine, said computer program comprising the steps of:

detecting an air/fuel ratio in exhaust gas of the engine;

detecting engine operating conditions including at least engine speed and engine load;

determining a basic quantity of fuel injection for a cylinder of the engine based on at least the detected engine operating conditions;

feedback controlling with an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value;

determining fuel cutoff based on the detected engine operating conditions;

determining an output quantity of fuel injection, while correcting the basic quantity of fuel injection using said feedback correction coefficient when engine operation is discriminated to be in a feedback control region, and determining the output quantity of fuel injection to be zero to cut a supply of fuel into the engine off when said fuel cutoff is determine; and injecting fuel into the cylinder of the engine based on the output quantity of fuel injection;

wherein:

setting at least one of the internal variables of the adaptive controller to a predetermined value when the supply of fuel is resumed after termination of the fuel cutoff, and causing the adaptive controller to calculate the feedback correction coefficient based on the internal variables set to the predetermined value.

83. A computer program according to claim 82, wherein the feedback correction coefficient is held to a predetermined value during the fuel cutoff.

84. A computer program according to claim 82, wherein the adaptive controller is caused to continue to calculate the feedback correction coefficient during the fuel cutoff.

85. A computer program according to claim 82, wherein the one of the internal variables set to the predetermined value is the feedback correction coefficient.

86. A computer program according to claim 82, wherein the one of the internal variables set to the predetermined value is the detected air/fuel ratio.

87. A computer program according to claim 82, wherein the one of the internal variables set to the predetermined value is the controller parameters.

88. A computer program according to claim 82, wherein the one of the internal variables set to the predetermined value is a gain matrix that determines an estimation speed of the controller parameters.

89. A computer program according to claim 82, wherein the one of the internal variables set to the predetermined value is an input, which is input to the adaptation mechanism.

90. A computer program according to claim 82 wherein, at least one of the internal variables of the adaptive controller is set to a predetermined value for a predetermined period when the supply of fuel is resumed after termination of the fuel cutoff.

91. A computer program according to claim 82, wherein the one of the internal variables includes its past value.

92. A computer program according to claim 82, wherein the feedback correction coefficient is multiplied by the basic quantity of fuel injection.

93. A computer program according to claim 82, wherein the internal variables are expressed in a recursion formula.

94. A system for controlling fuel metering for a multicylinder internal combustion engine, comprising:

an air/fuel ratio sensor located in an exhaust system of the engine for detecting an air/fuel ratio in exhaust gas of the engine;

engine operating condition detecting means for detecting engine operating conditions including at least engine speed and engine load;

control means, coupled to said air/fuel ratio sensor and said engine operating condition detecting means, for controlling an amount of fuel injected, said control means including a) basic fuel injection quantity determining means coupled to said engine operating condition detecting means, for determining a basic quantity of fuel injection for a cylinder of the engine based on at least the detected engine operating conditions, b) a feedback loop means coupled to said basic fuel injection quantity determining means, having an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value, c) fuel cutoff determining means for determining fuel cutoff based on the detected engine operating conditions, d) output fuel injection quantity determining means for determining an output quantity of fuel injection, said output fuel injection quantity determining means correcting the basic quantity of fuel injection using said feedback correction coefficient when engine operation is discriminated to be in a feedback control region, said output fuel injection quantity determining means determining the output quantity of fuel injection to be zero to cut a supply of fuel into the engine off when said fuel cutoff determining means determines that the fuel is cut off; and fuel injection means coupled to said control means, for injecting fuel into the cylinder of the engine based on the output quantity of fuel injection;

wherein:

said feedback loop means sets at least one of the internal variables of the adaptive controller to a predetermined value when the supply of fuel is resumed after termination of the fuel cutoff, and causes the adaptive controller to calculate the feedback correction coefficient based on the internal variables set to the predetermined value.

95. A system according to claim 94, wherein said feedback loop means holds the feedback correction coefficient to a predetermined value during the fuel cutoff.

96. A system according to claim 94, wherein said feedback loop means causes the adaptive controller to continue to calculate the feedback correction coefficient during the fuel cutoff.

97. A system according to claim 94, wherein one of the internal variables set to the predetermined value is the feedback correction coefficient.

98. A system according to claim 94, wherein one of the internal variables set to the predetermined value is the detected air/fuel ratio.

99. A system according to claim 94, wherein one of the internal variables set to the predetermined value is the controller parameters.

100. A system according to claim 94, wherein one of the internal variables set to the predetermined value is a gain matrix that determines an estimation speed of the controller parameters.

101. A system according to claim 94, wherein one of the internal variables set to the predetermined value is an input, which is input to the adaptation mechanism.

102. A system according to claim 94, wherein said feedback loop means sets at least one of the internal variables of the adaptive controller to a predetermined value for a predetermined period when the supply of fuel is resumed after termination of the fuel cutoff.

103. A system according to claim 94, wherein one of the internal variables includes its past value.

104. A system according to claim 94, wherein the feedback correction coefficient is multiplied by the basic quantity of fuel injection.

* * * * *